US005621282A

United States Patent [19]

Haskell

[11] Patent Number: 5,621,282

[45] Date of Patent: Apr. 15, 1997

[54] PROGRAMMABLE DISTRIBUTIVELY CONTROLLED LIGHTING SYSTEM

[76] Inventor: Walter Haskell, 12502 Raven South Dr., Houston, Tex. 77429

[21] Appl. No.: 420,281

[22] Filed: Apr. 10, 1995

[51] Int. Cl.[6] ..... H05B 37/00

[52] U.S. Cl. ..... 315/324; 315/292; 315/317; 315/316; 307/36; 307/38; 307/40; 364/140; 364/146

[58] Field of Search ..... 315/317, 316, 315/324, 314, 318, 291, 292, 293, 294, 295; 364/140, 145, 146; 307/31, 36, 38, 39, 40

[56] References Cited

U.S. PATENT DOCUMENTS

| | | | |
|---|---|---|---|
| 3,784,875 | 1/1974 | Baker et al. | 315/294 |
| 4,095,139 | 6/1978 | Symonds et al. | 315/153 |
| 4,240,011 | 12/1980 | Dinges et al. | 315/292 |
| 4,241,295 | 12/1980 | Williams, Jr. | 315/294 |
| 4,388,567 | 6/1983 | Yamazaki et al. | 315/291 |
| 4,398,131 | 8/1983 | Tarroux et al. | 315/294 |
| 4,716,344 | 12/1987 | Newell et al. | 315/312 |
| 4,924,151 | 5/1990 | D'Aleo et al. | 315/295 |
| 5,010,459 | 4/1991 | Taylor et al. | 362/85 |
| 5,066,896 | 11/1991 | Bertenshaw et al. | 315/291 |
| 5,381,078 | 1/1995 | Szuba | 315/316 |
| 5,420,482 | 5/1995 | Phares | 315/292 |

*Primary Examiner*—Robert Pascal
*Assistant Examiner*—Arnold Kinkead
*Attorney, Agent, or Firm*—Larry Mason Lee

[57] ABSTRACT

A lighting control system consisting of microcontroller enabled modular lighting circuits linked by asynchronous serial communication originating in a microprocessor.

3 Claims, 13 Drawing Sheets

PROGRAMMABLE DISTRIBUTIVELY CONTROLLED LIGHTING SYSTEM

SUMMARY OF THE INVENTION a. Field of Invention

Lighting control systems are a well-developed, well-understood field of art. Many of such control systems are designed to control the selection (on-off condition) of a given lamp in an array, either with or without an intensity control. However, within such field there are no available lighting control systems which are programmable, having each lamp circuit individually addressable, and modularized, with all of its attendant savings in inventory, maintenance, and construction cost, and its flexibility in layout and expandability.

Accordingly, the present invention relates to the field of apparatus to control the selection (on-off condition) of a given lamp in an array.

More particularly, the present invention relates to programmable apparatus to control the selection (on-off condition) of a given lamp in an array.

Yet more particularly, the present invention relates to programmable apparatus to control the selection (on-off condition) of a given lamp in an array wherein the lamp arrays are modular.

b. Background of the Invention

Prior art in the field of lighting control systems includes lighting control systems designed to control the selection (on-off condition) of a given lamp in an array. However, there are no known lighting control systems which are programmable, have each lamp individually addressable via asynchronous serial communication, and modularized, with all of its attendant savings in inventory, maintenance, and construction cost, and its flexibility in layout and expandability.

A substantial need exists for lighting control systems designed to control the selection (on-off condition) of a given lamp in an array.

An additional need exists for lighting control systems designed to control the selection (on-off condition) of a given lamp in an array which are programmable, having each lamp circuit individually addressable while utilizing a minimum number of control or signal wires.

A further need exists for lighting control systems designed to control the selection (on-off condition) of a given lamp in an array which are programmable, having each lamp circuit individually addressable while utilizing a minimum number of control or signal wires, and modularized, with all of its attendant savings in inventory, maintenance, and construction cost, and its flexibility in layout and expandability.

Accordingly, it is a primary object of this invention to provide a lighting control system designed to control the selection (on-off condition) of a given lamp in an array.

It is another object of this invention to provide a lighting control system designed to control the selection (on-off condition) of a given lamp in an array which is programmable, having each lamp circuit individually addressable while utilizing a minimum number of control or signal wires.

It is a further and final object of this invention to provide a lighting control system designed to control the selection (on-off condition) of a given lamp in an array which is programmable, having each lamp circuit individually addressable while utilizing a minimum number of control or signal wires, and modularized, with all of the attendant savings in inventory, maintenance, and construction cost, and the flexibility in layout and expandability that derives from modularity.

DESCRIPTION OF THE PREFERRED EMBODIMENT

Figure 1:
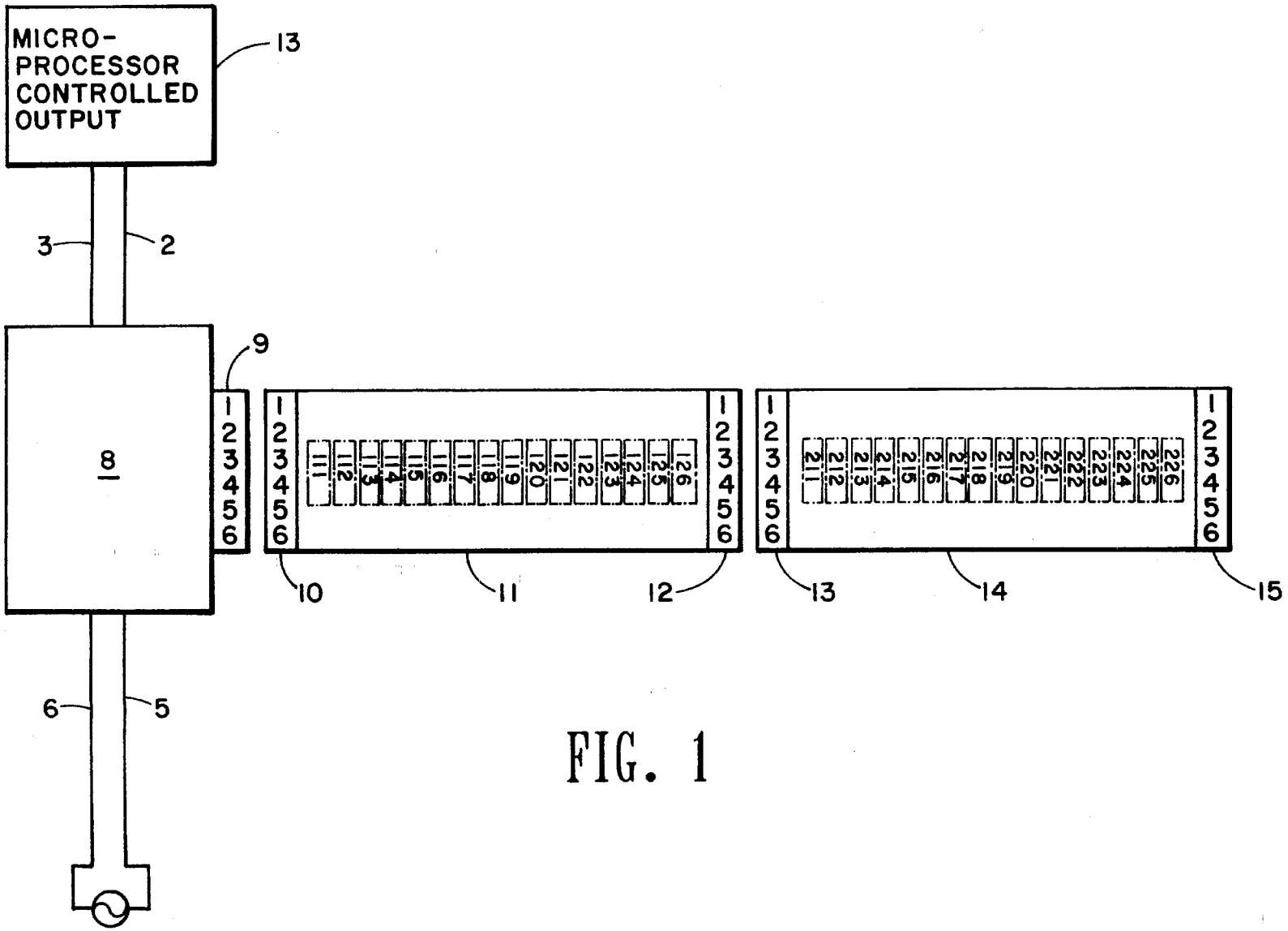
FIG. 1 is a block diagrammic overall view of the instant invention.

As seen in FIG. 1, the instant invention comprises a microprocessor controlled output (13) which would commonly be a personal computer, a RS-232 to RS-485 serial data converter (8), a dynamic lighting module (11), and a subsequent, serially connected, dynamic lighting module (14). The microprocessor controlled asynchronous serial data output (1) is electrically connected through the RS-232 transmit line (2) and the RS-232 return (3) to the standard RS-232 9 pin connector (28) at the input of the RS-232 to RS-485 serial data converter (8). 110 VAC is depicted as originating at the generator source (4) and being transmitted via the 110 VAC supply line (5) and the 110 VAC return line (6) to the RS-232 to RS-485 serial data converter (8). The output of the RS-232 to RS-485 serial data converter (8) is electrically connected to pins 1 and 2 of the output header (9). The 110 VAC is electrically connected to pins 3 and 4 of the output header (9), and the output of the +9 VDC power supply (7), seen in FIG. 2, is electrically connected to pins 5 and 6 of the output header (9).

As further seen in FIG. 1, a dynamic lighting module (11) is serially connected to the output header (9) through the input header (10), and further serially connected through the output header (12) and the input header (13) to the dynamic lighting module (14). The dynamic lighting module (11) is identical to the dynamic lighting module (14) and may be interchanged therewith. A total of 254 dynamic lighting modules (11 or 14) may be serially connected in the preferred embodiment of the instant invention.

Figure 2:
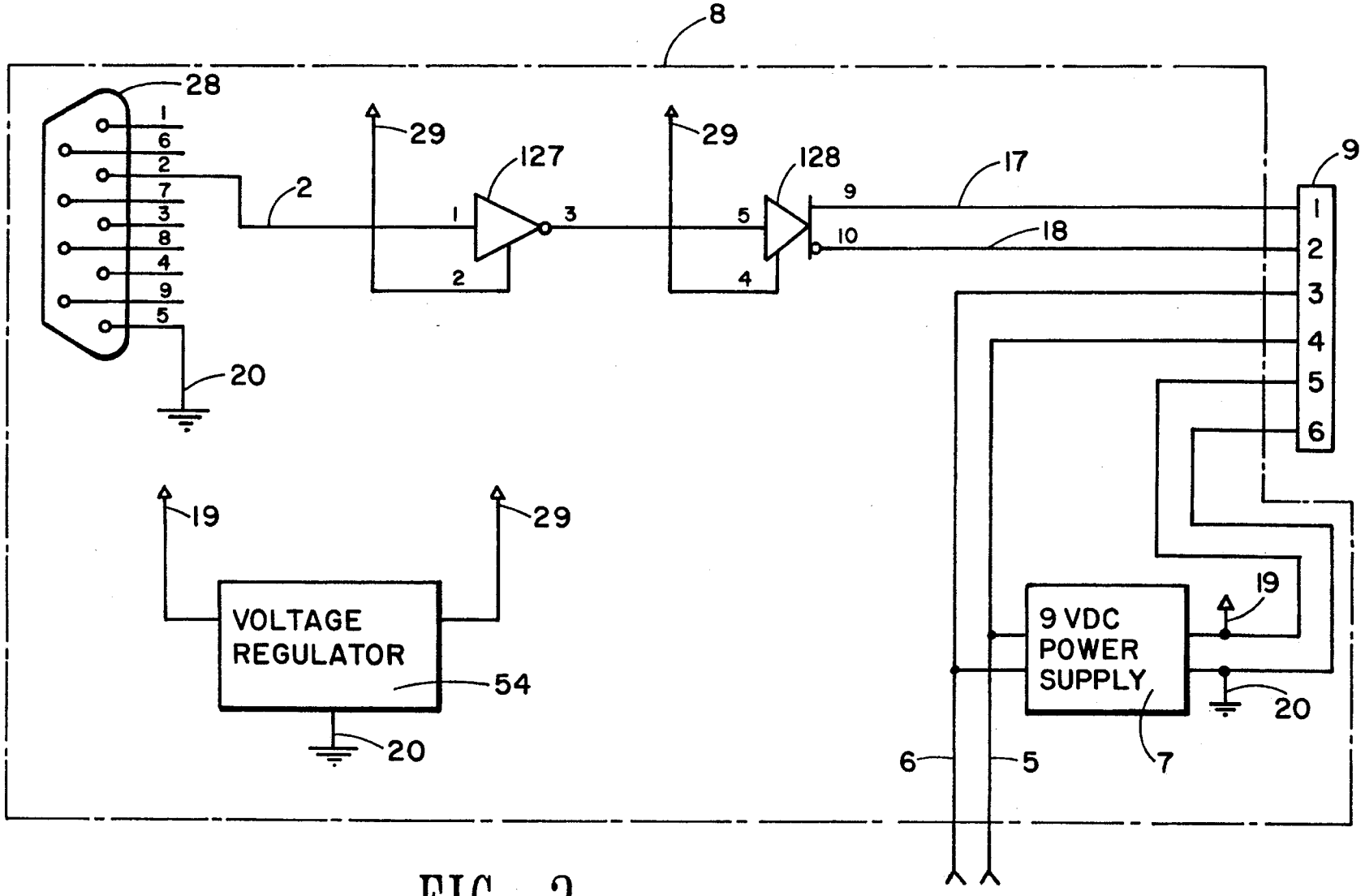
FIG. 2 is a schematic diagram of the RS-232 to RS-485 converter of the instant invention.

FIG. 2 is a circuit diagram of the RS-232 to RS-485 serial data converter (8). The RS-232 transmit line (2) and the common (20) are electrically connected through header (28) to the input of driver (127) which is input to a differential amplifier (128). The driver (127) together with the differential amplifier (128) act as a differential driver and receiver pair and comprise the signal converting circuitry of the RS-232 to RS-485 serial data converter (8), which acts to change the signal level to a 0 VDC to +5 VDC range. The differential output from the differential amplifier (128) of the RS-232 to RS-485 serial data converter (8) is electrically connected to pins 1 and 2 of the output header (9). 110 VAC is electrically connected to pins 3 and 4 of the output header (9) and to the input of the +9 VDC power supply (7). The output of the +9 VDC power supply (7) is electrically connected to the input of the voltage regulator (54) through the +9 VDC supply line (19) and the common (20). The voltage regulator (54) supplies +5 VDC to the driver (127) and the differential amplifier (128) through the +5 VDC supply line (29) and the common (20).

Figure 3:
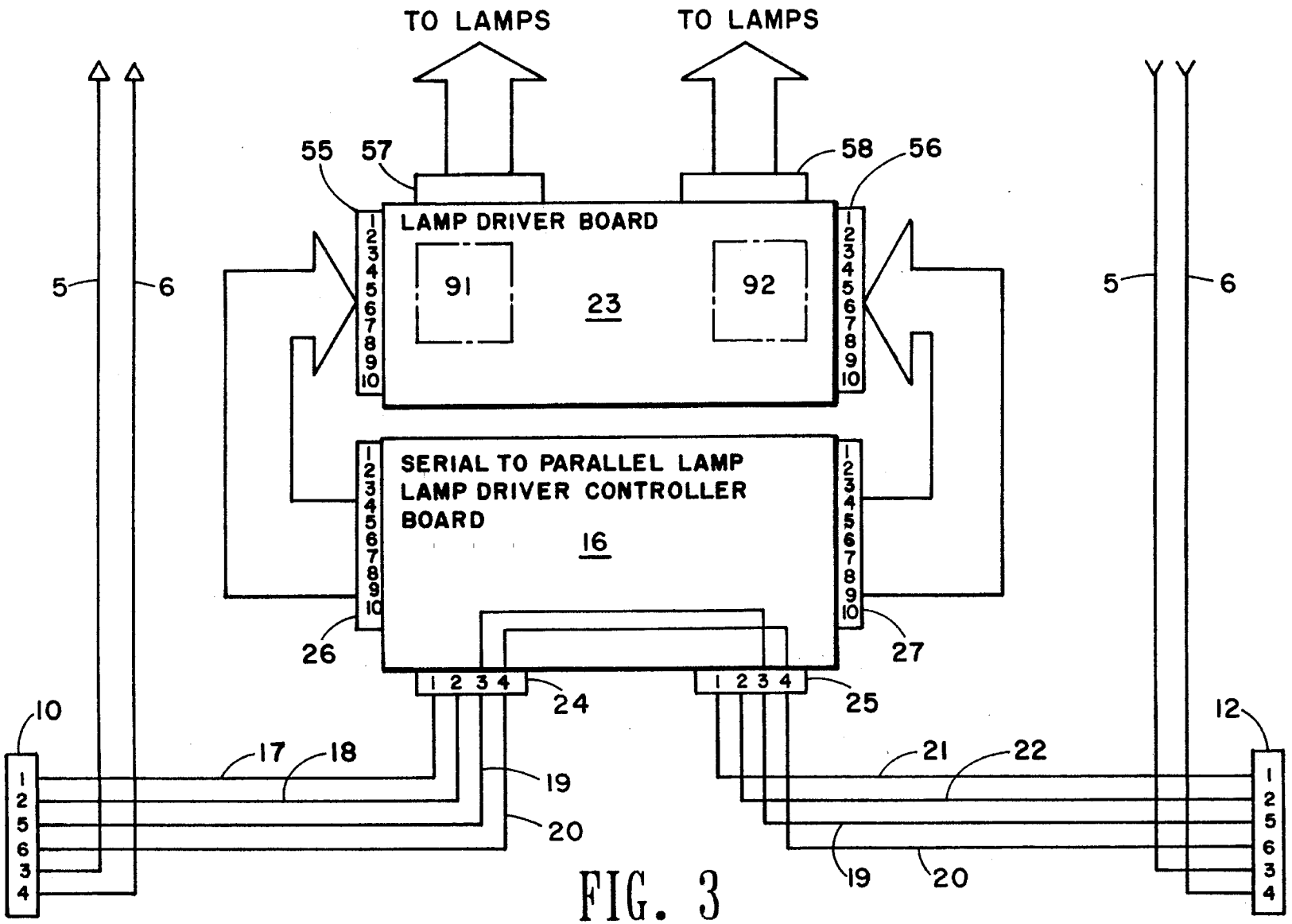
FIG. 3 is a block diagrammic view of the interconnection between the serial to parallel lamp driver controller board and the lamp driver board of the instant invention.

FIG. 3 is a block diagram of the dynamic lighting module (11). +9 VDC is supplied to the serial to parallel lamp driver controller board (16) through the +9 VDC supply line (19) and the common (20) connection at pins 3 and 4 of the input header (24). Pins 3 and 4 of the input header (24) are electrically connected to pins 3 and 4 respectively of the output header (25), thus supplying +9 VDC power to the next dynamic lighting module (14) through pins 5 and 6 of the output header (12). The incoming RS-485 input signal is electrically connected through RS-485 input line (17) and the RS-485 input complement line (18) from pins 1 and 2 of the input header (10) to pins 1 and 2 respectively of the input header (24). Pins 1 and 2 of the output header (25) are electrically connected to pins 1 and 2, respectively, of the output header (12) through the RS-485 output line (21) and the RS-485 output complement line (22). The output signals that control lamps 1 through 8 (111–118) are electrically connected through the output header (26) for the serial to parallel lamp driver controller board (16) to the input header (55) for the lamp driver board (23). Pins 1 through 10 on the output header (26) of the serial to parallel lamp driver controller board (16) are electrically connected to pins 1 through 10 on the input header (55) of the lamp driver board (23). The output signals that control lamps 9 through 16 (119–126) are electrically connected through the output header (27) of the serial to parallel lamp driver controller board (16) to the input header (56) of the lamp driver board (23). Pins 1 through 10 on the output header (27) of the serial to parallel lamp driver controller board (16) are electrically connected to pins 1 through 10 on the input header (56) of the lamp driver board (23). The 110 VAC supply line (5) and the 10 VAC return line (6) are electrically connected to pins 3 and 4, respectively, of the input header (10) and to pins 3 and 4, respectively, of the output header (12). 110 VAC is supplied from the input header (10) in FIG. 3 to each lamp and trigger circuit (111–126) in FIG. 6. The lamp (96) of each lamp and trigger circuit (111–126) in FIG. 6 is electrically connected to the 110 VAC supply line (5). The triac (97) of each lamp and trigger circuit shown (111–126) in FIG. 6 is electrically connected to the 110 VAC return line (6). The output header (57) of the lamp driver board (23) is electrically connected to the output of the lamp driver card (91), see FIG. 5, and to the input of the first eight lamp and trigger circuits (111–118). The output header (58) of the lamp driver board (23) is electrically connected to the output of the lamp driver card (92), see FIG. 5, and to the input of the second eight lamp and trigger circuits (119–126).

Figure 4:
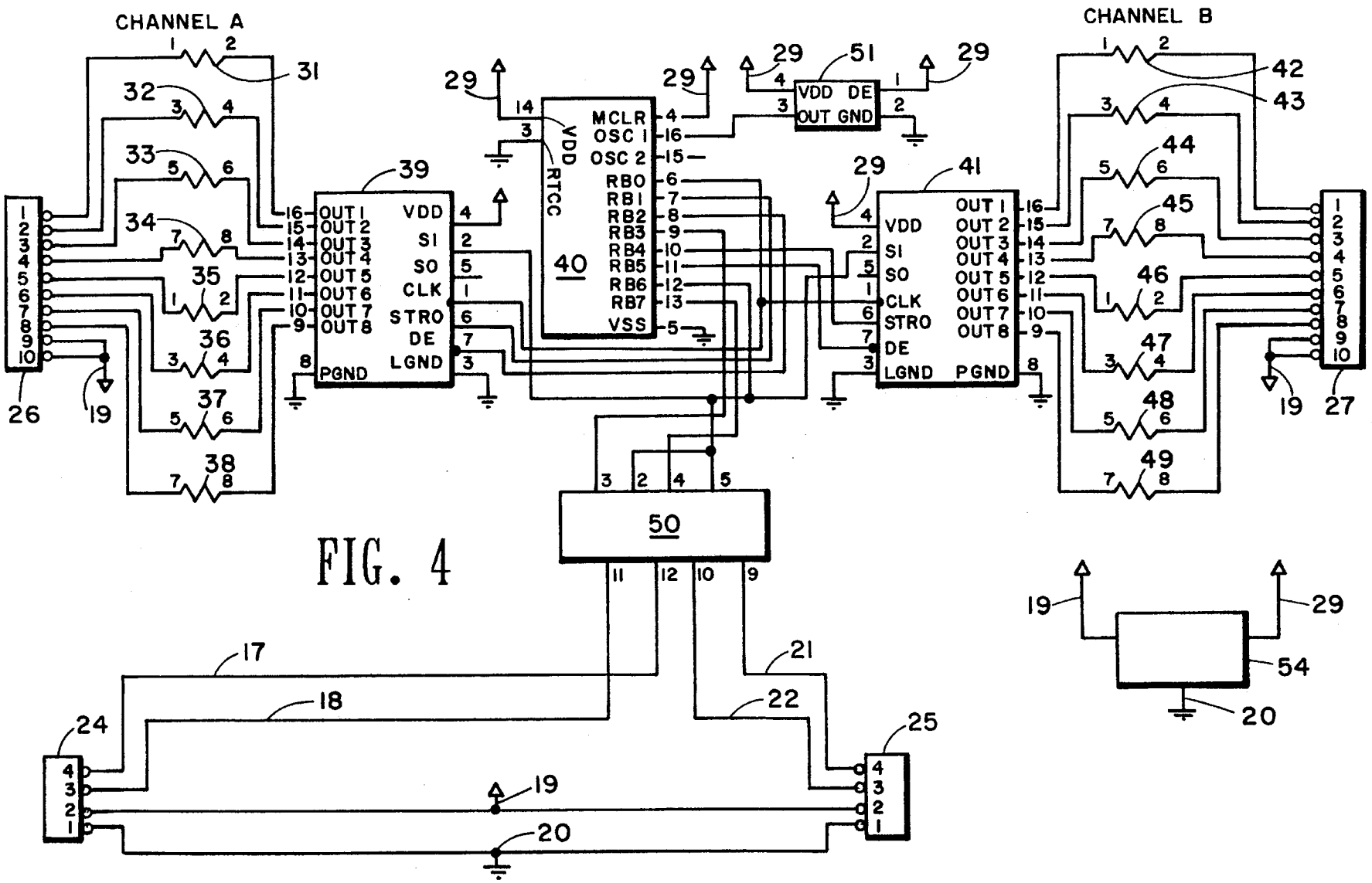
FIG. 4 is a schematic diagram of the serial to parallel lamp driver controller board of the instant invention.
Figure 7A:
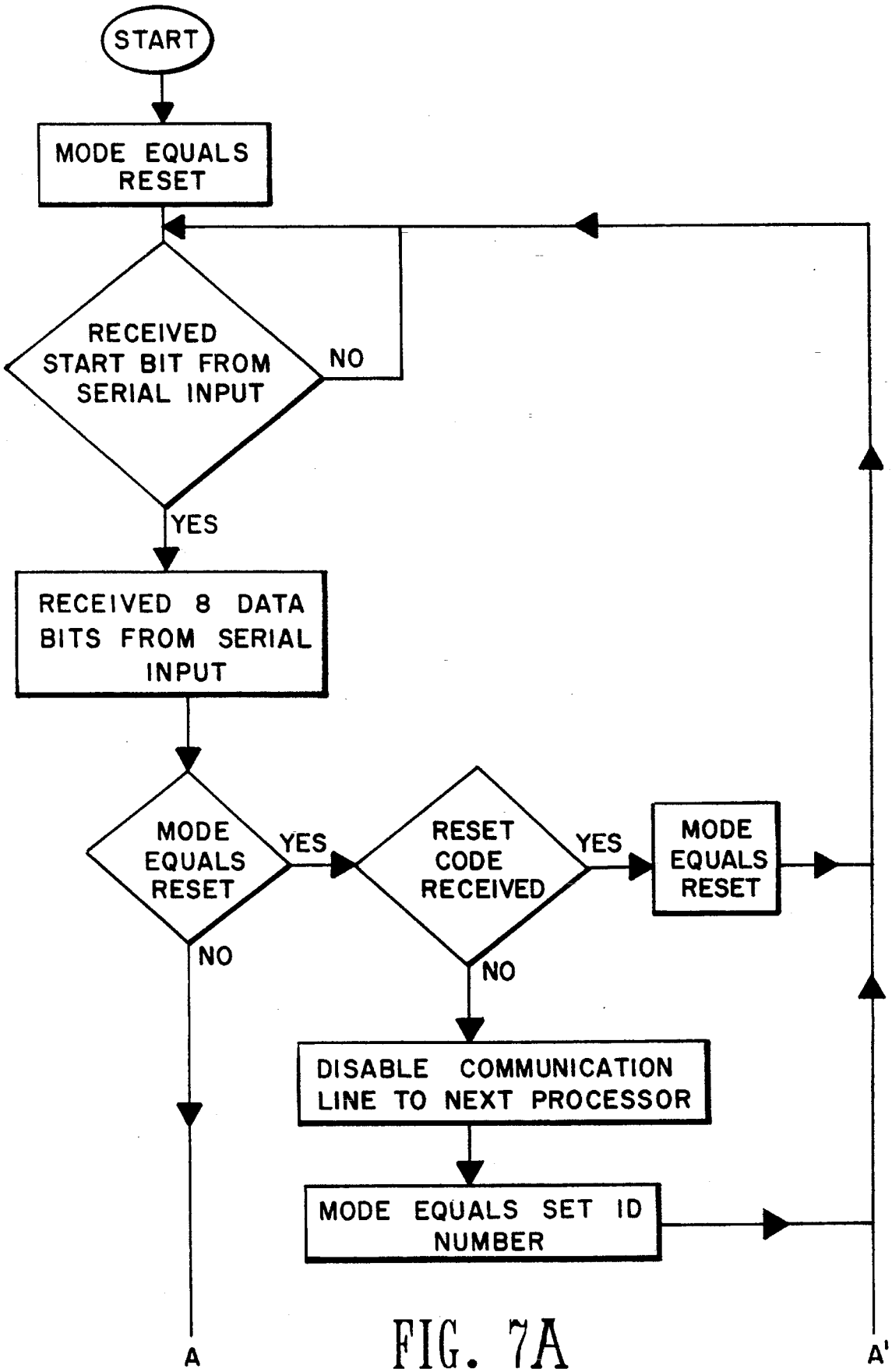
FIG. 7A is part one of three parts of the flow chart of the program installed in the EPROM-based 8 bit CMOS microcontroller of the instant invention.
Figure 7B:
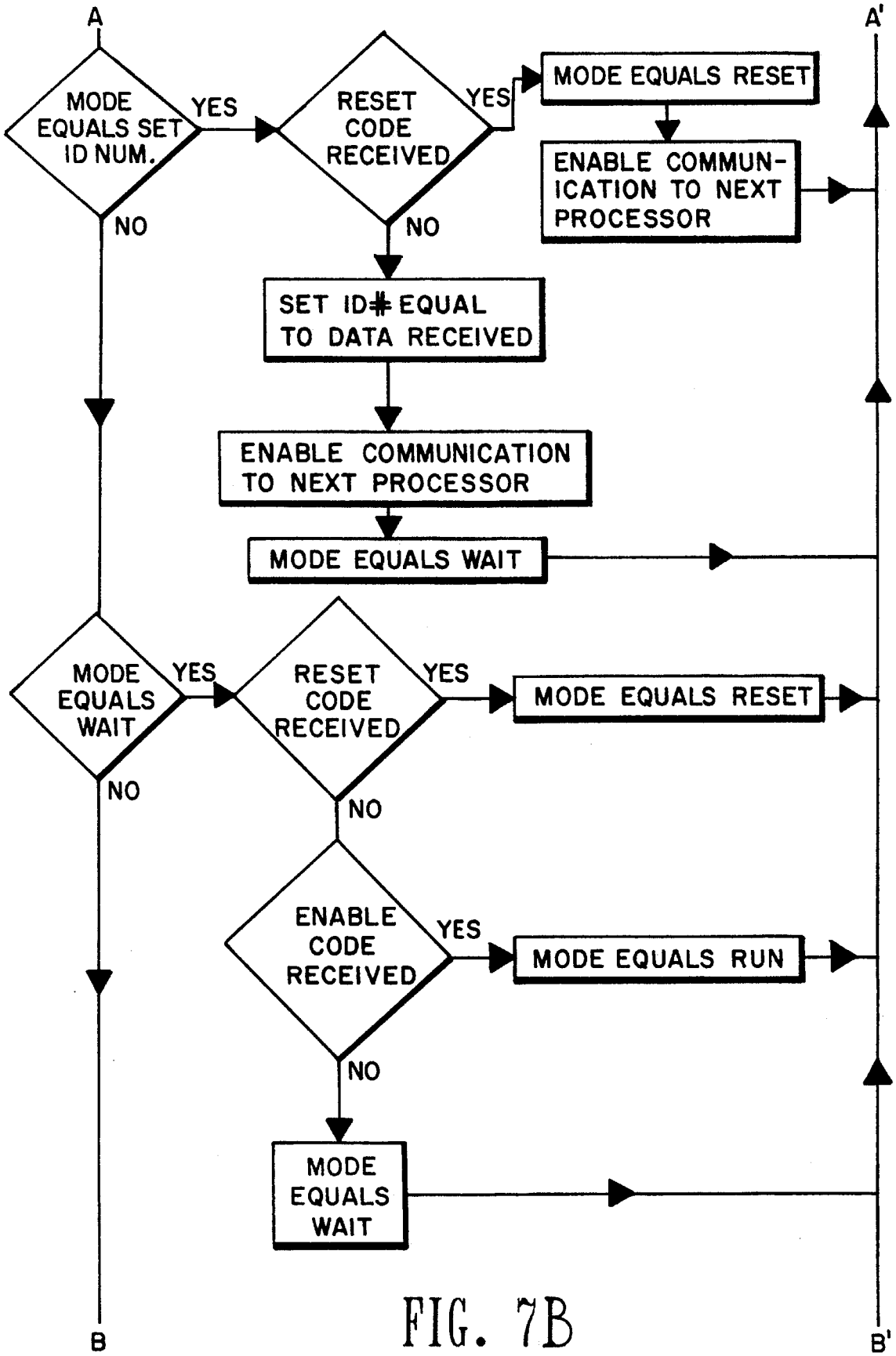
FIG. 7B is part two of three parts of the flow chart of the program installed in the EPROM-based 8 bit CMOS microcontroller of the instant invention.
Figure 7C:
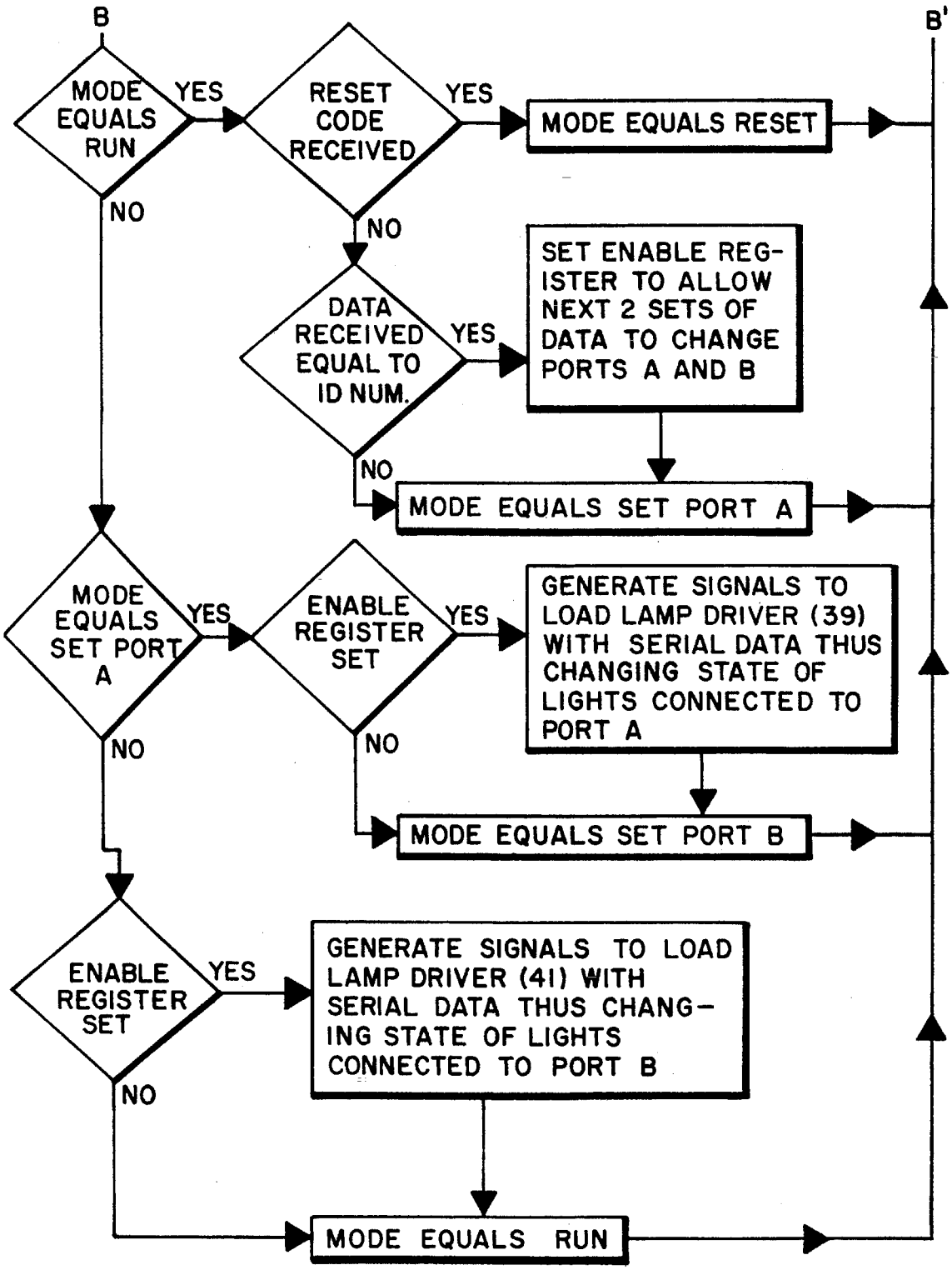
FIG. 7C is part three of three parts of the flow chart of the program installed in the EPROM-based 8 bit CMOS microcontroller of the instant invention.

FIG. 4 is a circuit diagram of the serial to parallel lamp driver controller board (16). The +9 VDC supply line (19) and the common (20) are electrically connected to pins 3 and 4, respectively, of the input header (24) of the serial to parallel lamp driver controller board (16). The +9 VDC supply line (19) and the common (20) are, additionally, electrically connected to pins 3 and 4 of the output header (25) of the serial to parallel lamp driver controller board (16). The +9 VDC supply line (19) and the common (20) are, internal to the serial to parallel lamp driver controller board (16), electrically connected to a voltage regulator (54) which supplies +5 VDC to the +5 VDC supply line (29). The +9 VDC supply line (19) is electrically connected to the output headers (26 and 27) of the serial to parallel lamp driver controller board (16). The differential driver and receiver pair (50) is electrically connected, at its input pins 12 and 11, to the RS-485 input line (17) and the RS-485 input complement line (18). The output at pin 2 of the differential driver and receiver pair (50) is a logic level signal allowing the EPROM-based 8 bit CMOS microcontroller (40) to read the signal at its input pin 12. The logic level signal, a converted asynchronous serial data signal, at output pin 2 of the differential driver and receiver pair (50) is also electrically connected to the input pin 2 of each of the 8 bit serial input latched parallel output integrated circuits (39 and 41). The 8 bit serial input latched parallel output integrated circuit (39) acts to convert the serial data input to parallel data which is output to the lamp and trigger circuits (111–118), and the 8 bit serial input latched parallel output integrated circuit (41) acts to convert the serial data input to parallel data which is output to the lamp and trigger circuits (119–126). The converted signal at output pin 2 of the differential driver and receiver pair (50) is electrically connected to input pin 5 of the differential driver and receiver pair (50) which then acts to convert the signal back to a differential signal which is connected electrically to pins 3 and 4 of the output header (25). The output, at pin 9, of the EPROM-based 8 bit CMOS microcontroller (40), is electrically connected to the input pin 3 of the differential driver and receiver pair (50). The input, at pin 3 of the differential driver and receiver pair (50), acts to enable and disable the receiver portion of the differential driver and receiver pair (50). The EPROM-based 8 bit CMOS microcontroller (40), through the electrical connection of its output at pin 13 to the input pin 4 of the differential driver and receiver pair (50), acts to enable and disable the driver portion of the differential driver and receiver pair (50). The EPROM-based 8 bit CMOS microcontroller (40), by enabling and disabling the driver portion of differential driver and receiver pair (50), thus controls the flow of the asynchronous serial data Lighting module (14). FIGS. 7*a*, 7*b*, and 7*c* are, together, the flow chart of the program installed in the EPROM-based 8 bit CMOS microcontroller. Output pin 6 of the EPROM-based 8 bit CMOS microcontroller (40) is electrically connected to input pin 1 of both of the 8 bit serial input latched parallel output integrated circuits (39 and 41). The input at pin 1 of each of the 8 bit serial input latched parallel output integrated circuit (39 and 41) clocks in the asynchronous serial data received on the RS-485 lines (17 and 18). The strobe signal input on pin 6 of the 8 bit serial input latched parallel output integrated circuit (39) is generated by and output from pin 7 of the EPROM-based 8 bit CMOS microcontroller (40). The strobe signal input on pin 6 of the 8 bit serial input latched parallel output integrated circuit (41) is generated by and output from pin 10 of the EPROM-based 8 bit CMOS microcontroller (40). Input pin 7 of the 8 bit serial input latched parallel output integrated circuit (39) is electrically connected to output pin 8 of the EPROM-based 8 bit CMOS microcontroller (40). Input pin 7 of the 8 bit serial input latched parallel output integrated circuit (41) is electrically connected to output pin 11 of the EPROM-based 8 bit CMOS microcontroller (40). The 20 MHz crystal oscillator (51) is electrically connected to input pin 16 of the EPROM-based 8 bit CMOS microcontroller (40). The outputs of the 8 bit serial input latched parallel output integrated circuit (39), on pins 16 through 9, are electrically connected to one side of 470 ohm resistors (31 through 38). The other side of the 470 ohm resistors (31 through 38) are electrically connected to pins 1 through 8, respectively, of the output header (26) of the serial to parallel lamp driver controller board (16). The outputs of the 8 bit serial input latched parallel output integrated circuit (41), on pins 16 through 9, are electrically connected to one side of 470 ohm resistors (42 through 49). The other side of the 470 ohm resistors (42 through 49) are electrically connected to pins 1 through 8, respectively, of the output header (27) of the serial to parallel lamp driver controller board (16).

Figure 5:
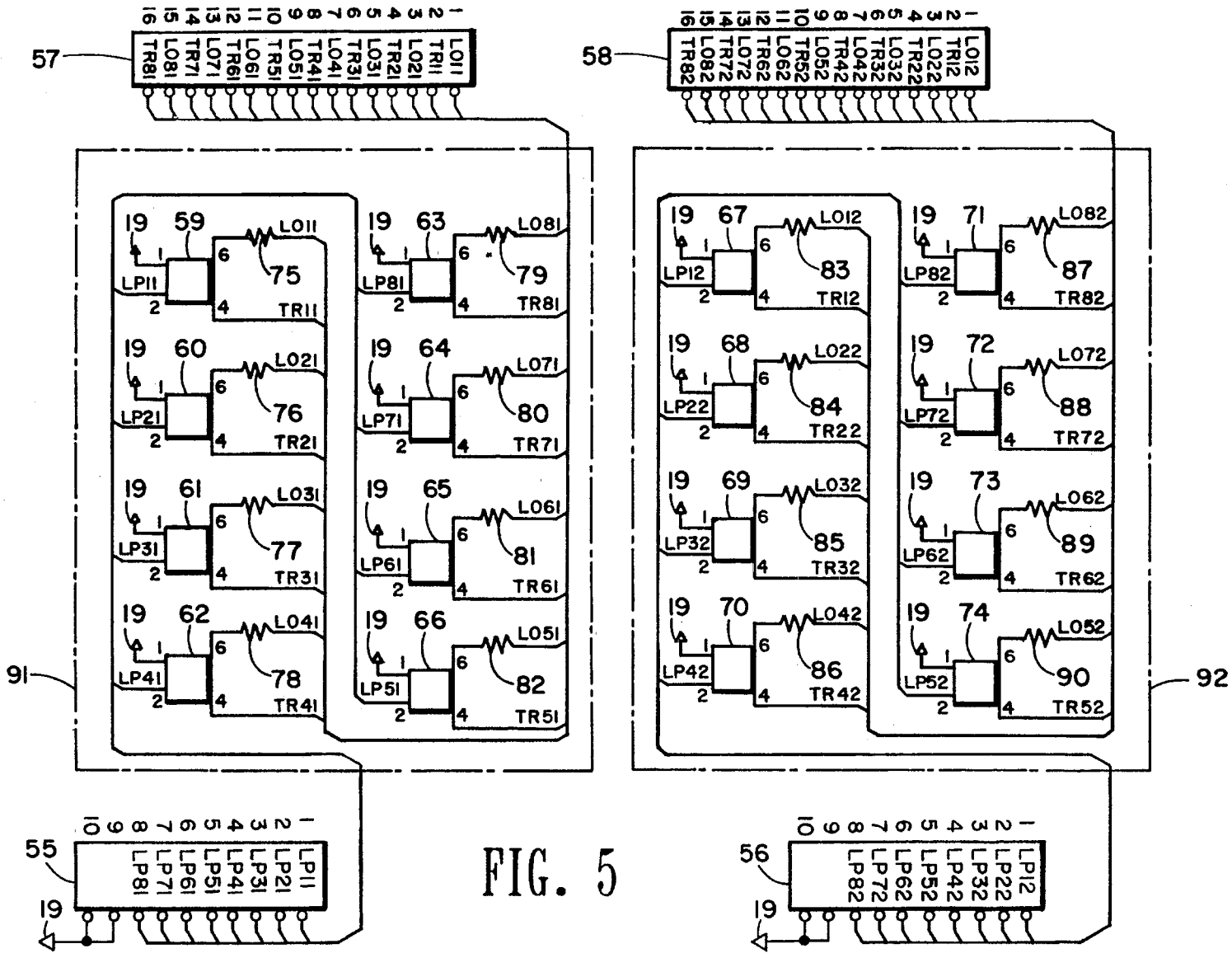
FIG. 5 is a schematic diagram of the lamp driver board of the instant invention.
Figure 6:
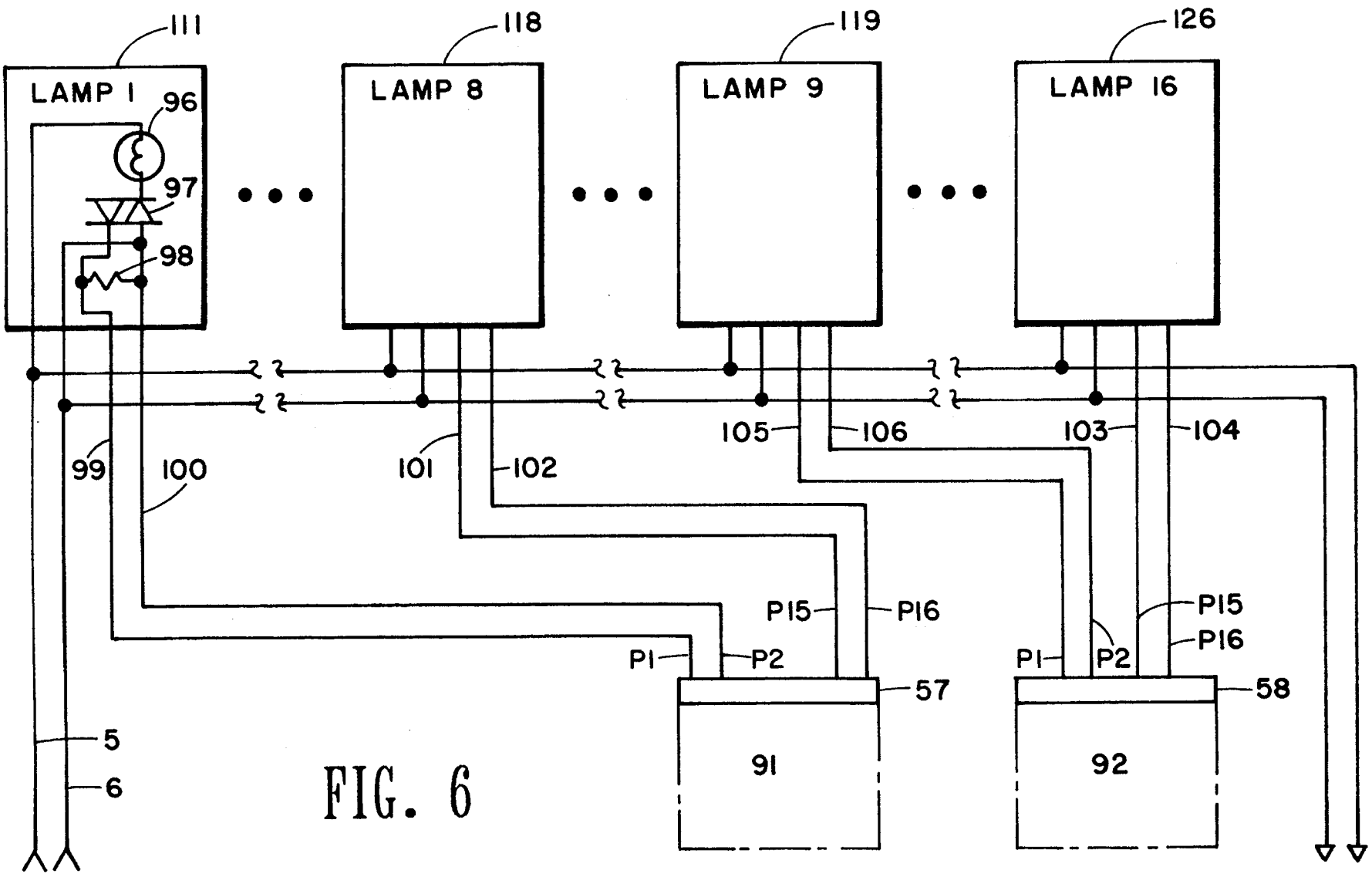
FIG. 6 is a schematic diagram of the modular lighting circuit of the instant invention.

FIG. 5 is a circuit diagram of the lamp driver board (23). The output header (26) for the serial to parallel lamp driver controller board (16), in FIG. 4, is electrically connected, pin number to like pin number, to the input header (55) for the lamp driver board (23). The output header (27) for the serial to parallel lamp driver controller board (16), in FIG. 4, is electrically connected, pin number to like pin number, to the input header (56) for the lamp driver board (23). Each lamp and trigger circuit (111 through 126) is optically isolated by an opto-isolated triac (59–74).

The eight lamp drivers (59 through 66) on the lamp driver card (91), port A, are electrically connected as follows. Pins 1 through 8 of the input header (55) for the lamp driver board (23) are each electrically connected to one of the first eight opto-isolated triacs (59 through 66). Pin 1 of the input header (55) is connected to pin 2 of the opto-isolated triac (59), pin 2 of the input header (55) is connected to pin 2 of the opto-isolated triac (60), and subsequent pin numbers of the input header (55) are connected to pin 2 of the subsequently numbered opto-isolated triac. Pin 4 of each of the first eight opto-isolated triacs (59–66) is electrically connected to even pin numbers starting with pin 2 and continuing through pin 16 of the output header (57) for the lamp driver board (23). Pin 6 of each of the first eight opto-isolated triacs (59–66) are electrically connected through 180 ohm resistors (75–82) to odd number pins starting with pin 1 to 15 of the output header (57) for the lamp driver board (23).

The following describes 8 lamp drivers for port B lamp driver card (92). Pin 1 of the input header (56) is connected to pin 2 of the opto-isolated triac (67), pin 2 of the input header (56) is connected to pin 2 of the opto-isolated triac (68), and subsequent pin numbers of the input header (56) are connected to pin 2 of the subsequently numbered opto-isolated triac. Pin 4 of each of the second eight opto-isolated triacs (67-74) are electrically connected to even pin numbers starting with pin 2 to pin 16 of the output header (58) for the lamp driver board (23). in 6 of each of the second eight opto-isolated triacs (67–74) are electrically connected through 180 ohm resistors (83–90) to odd number pins starting with pin 1 to 15 of the output header (58) for the lamp driver board (23).

FIG. 6 is a block diagram of the lamp and trigger wiring. The output of the 8 lamp drivers on the lamp driver card (91) for port A is electrically connected to the first eight lamp and trigger circuits (111–118) through the output header (57) for the lamp driver board (23). The first lamp and trigger circuit (111) is electrically connected as follows. One side of the lamp (96) is electrically connected to 110 VAC supply line (5) and the other side of the lamp (96) is electrically connected to pin 1 of the triac (97). Pin 2 of the triac is electrically connected to the 110 VAC return line (6), one side of a 1K ohm resistor (98), and pin 1 of the output header (57), pin 3 of the triac (97) is electrically connected to the other side of the 1K ohm resistor (98) and to pin 2 of the output header (57). All of the subsequent lamp and trigger circuits (112–126) are electrically connected in similar fashion. The outputs of the 8 lamp drivers on the lamp driver card (92) for port B are electrically connected to the second eight lamp and trigger circuits (119–126) through the output header (58) for the lamp driver board (23). Electrical connection of the lamp and trigger circuits (119–126) is electrically connected in similar fashion as that described for the lamp and trigger circuits (111–118) excepting that the header pin connections are to header (58).

Figure 8A:
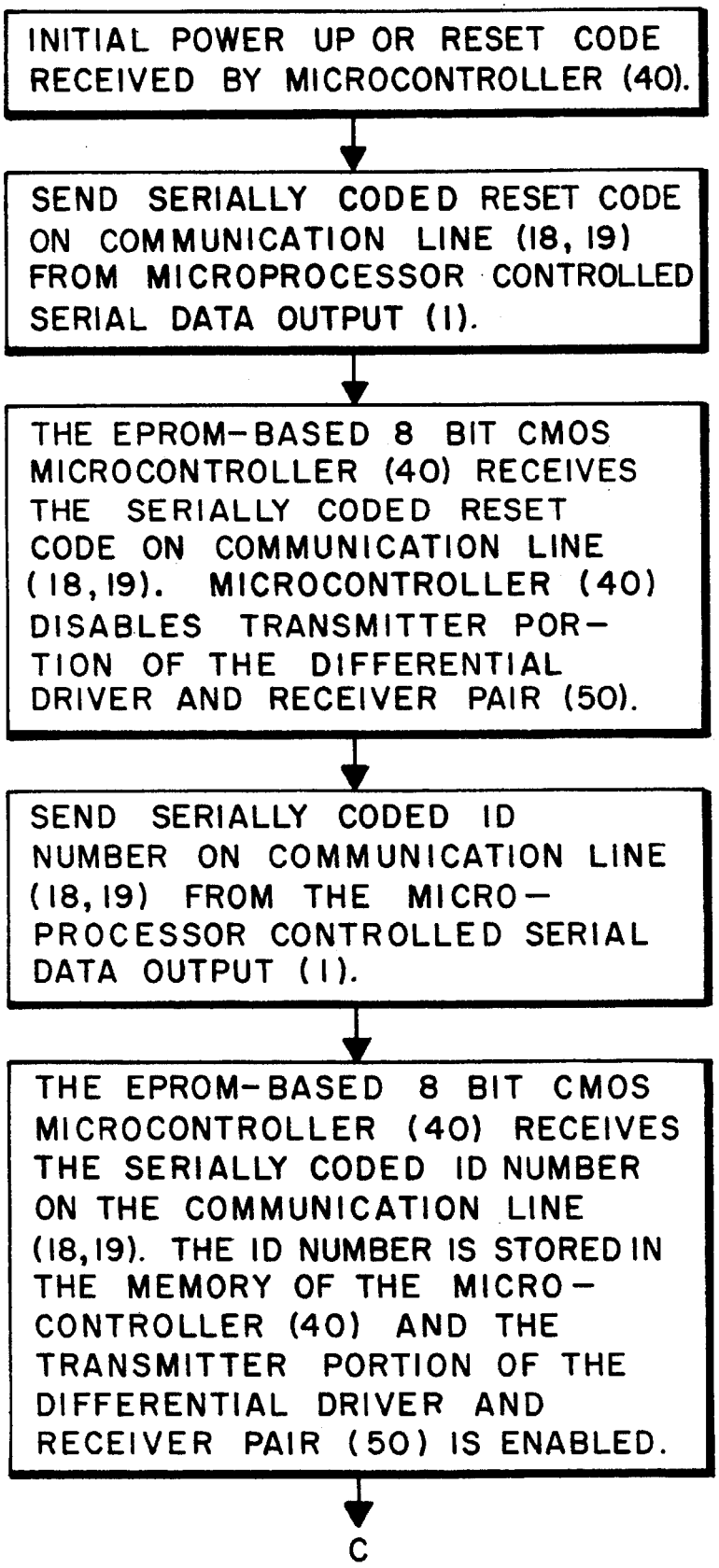
FIG. 8A is part one of two parts of the flow chart of the initialization mode of operation of the instant invention.
Figure 8B:
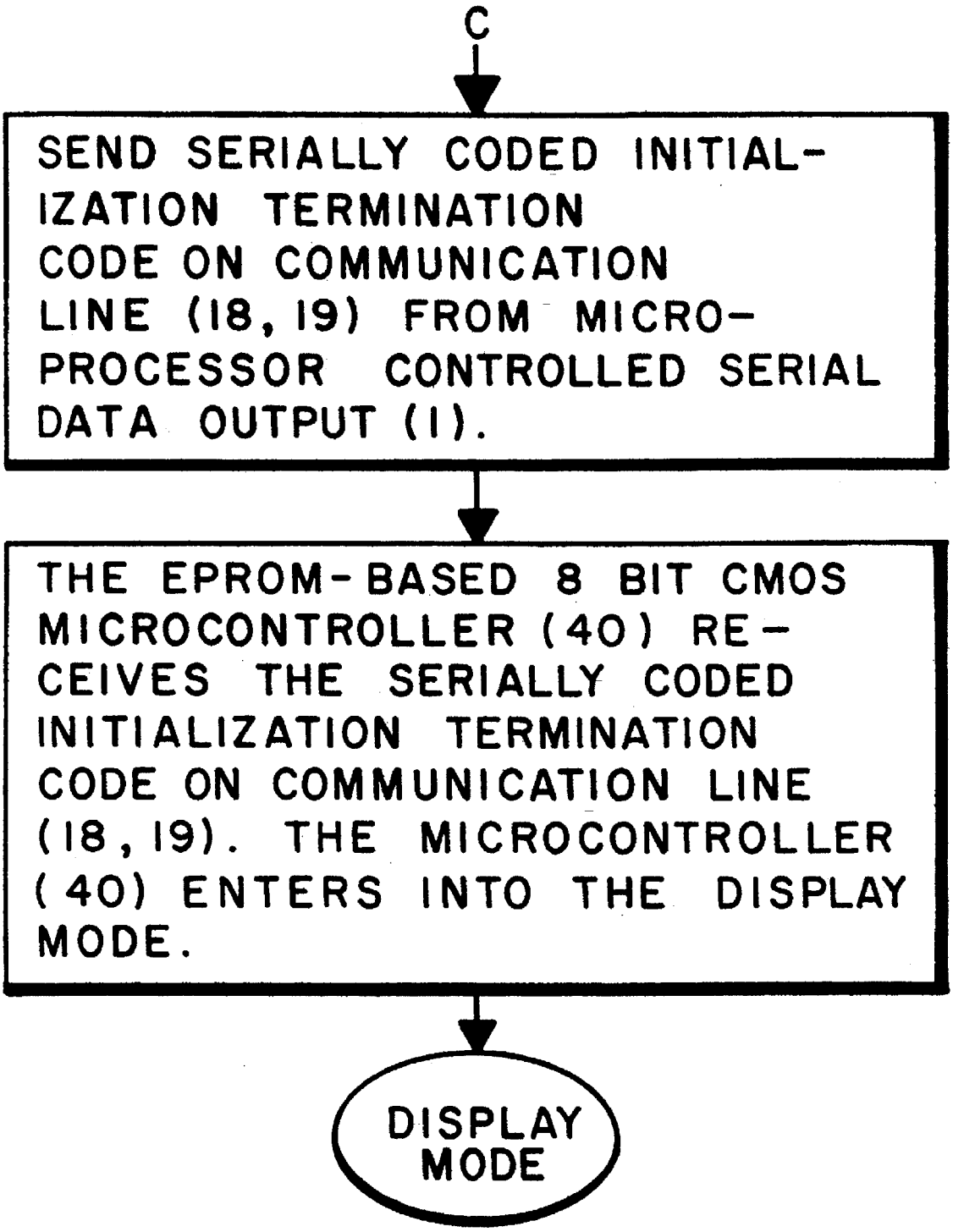
FIG. 8B is part two of two parts of the flow chart of the initialization mode of operation of the instant invention.
Figure 9A:
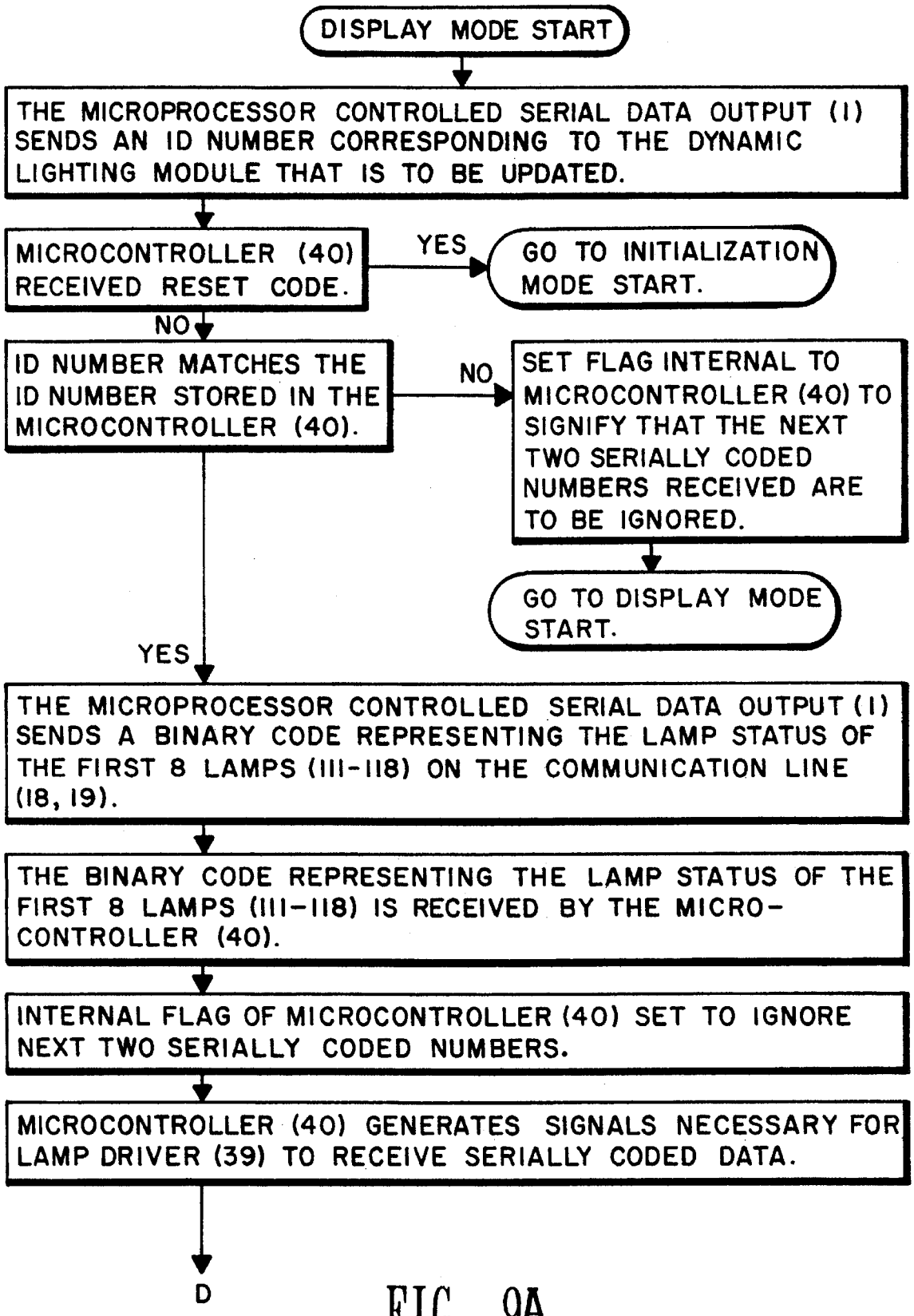
FIG. 9A is part one of two parts of the flow chart of the display mode of operation of the instant invention.
Figure 9B:
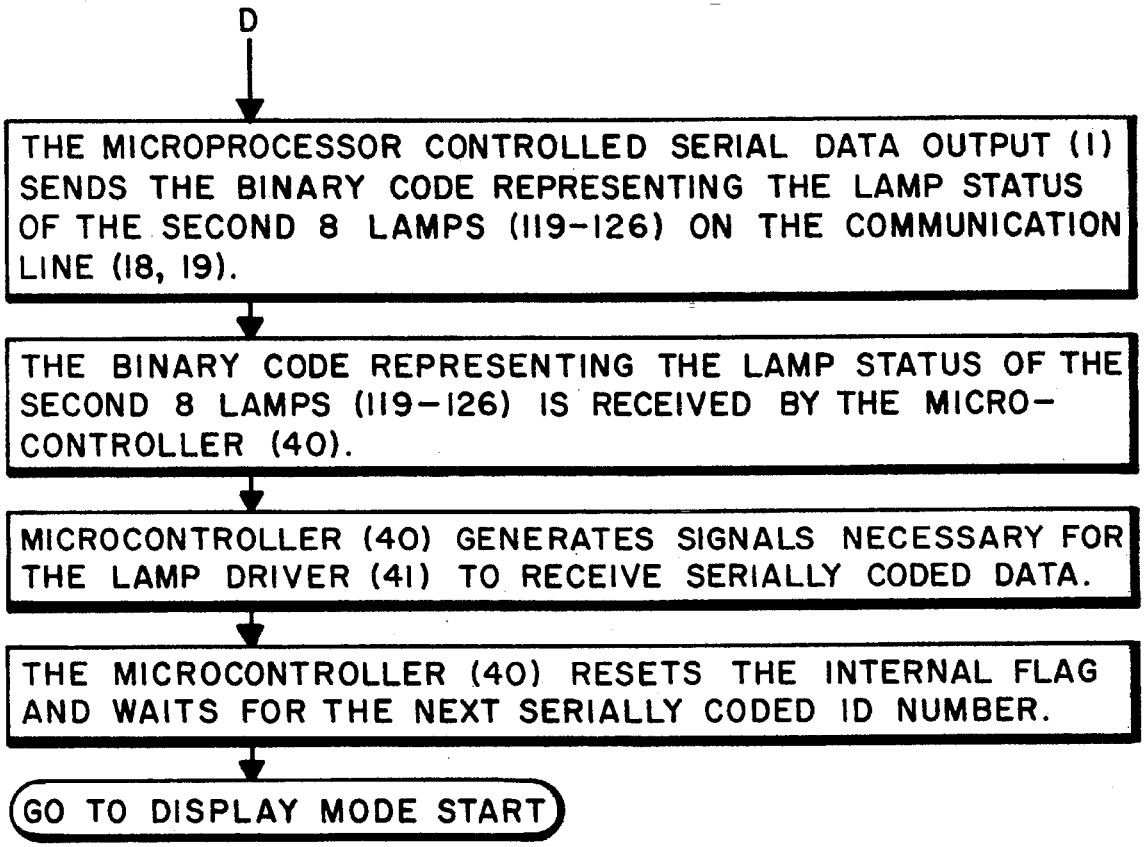
FIG. 9B is part two of two parts of the flow chart of the display mode of operation of the instant invention.

The preferred embodiment operates in two distinct modes: initialization mode, FIGS. 8*a* and 8*b*, and display mode FIGS. 9*a* and 9*b*. Initialization mode, FIGS. 8*a* and 8*b*, is required to set the internal identification numbers in each dynamic lighting module (11 and 14). Display mode, FIGS. 9*a* and 9*b* , allows the user to generate a lighting display sequence by output the appropriate serial data to the dynamic lighting module (11).

At power on, the preferred embodiment causes each EPROM-based 8 bit CMOS microcontroller (40) in each dynamic Lighting module to enter into initialization mode, FIGS. 8*a* and 8*b*. Initialization mode, FIGS. 8*a* and 8*b* , can also be initiated by sending the reset code from the microprocessor controlled asynchronous serial data output (13). After initialization, the microprocessor controlled asynchronous serial data output (1) sends the set identification code signal. The set identification code signal disables the transmitter portion of the differential driver and receiver pair (50). Thus, the identification code number signal is received only by the microcontroller EPROM-based 8 bit CMOS microcontroller (40) in the first dynamic lighting module (11). The identification code number signal for the first dynamic lighting module (11) is sent by the microprocessor controlled asynchronous serial data output (1) transmitting over the communication line (18, 19). After the identification code number signal is received by the EPROM-based 8 bit CMOS microcontroller (40) in the first dynamic lighting module (11) the transmitter portion of the differential driver and receiver pair (50) is enabled. The next identification code number signal sent by the microprocessor controlled asynchronous serial data output (13) will be received by the EPROM-based 8 bit CMOS microcontroller (40) in the second dynamic lighting module (14). The process of sending identification code number signals from the microprocessor controlled asynchronous serial data output (13) is repeated until all dynamic lighting modules (11, 14) in the system have an identification code number assigned. The identification code number is used when operating in the display mode, FIGS. 9*a* and 9*b*, to allow the microprocessor controlled asynchronous serial data output (13) to individually control each dynamic display module (11 and 14). A maximum of 254 different valid identification code numbers can be assigned. The microprocessor controlled asynchronous serial data output (13) sends display mode, FIGS. 9*a* and 9*b*, identification code number which enters each EPROM-based 8 bit CMOS microcontroller (40) in each dynamic lighting module (11 or 14) into the display mode, FIGS. 9*a* and 9*b*.

During the display mode, FIGS. 9*a* and 9*b*, of the preferred embodiment's operation, the microprocessor controlled asynchronous serial data output (13) controls the on-off condition of the lamps on each dynamic lighting module (11, 14) which electrically connected to the communication line. There may be up to 254 dynamic lighting modules (11, 14) modules electrically connected to the communication line. The microprocessor controlled asynchronous serial data output (13) controls each lamp on any dynamic lighting module (11 or 14) which, in the preferred embodiment, permits the user to create a program to run on such microprocessor to cause the microprocessor controlled asynchronous serial data output (13) to create any lighting display sequence desired.

The microprocessor controlled asynchronous serial data output (13) controls the lamps on the dynamic lighting modules (11 and 14) in the following manner. The microprocessor controlled asynchronous serial data output (13) first outputs on the communication line (18,19) the identification code number signal of the desired dynamic lighting module (11 or 14). All of the EPROM-based 8 bit CMOS microcontroller (40) with an identification code number that do not match the identification code number received set an internal flag which signifies that the next two serially coded numbers received are to be ignored. The EPROM-based 8 bit CMOS microcontroller (40) that has the matching identification code number clears the internal flag whereby the next two serially coded numbers received by such EPROM-based 8 bit CMOS microcontroller (40) are not ignored. The next serially coded number is sent to the first eight lamp and trigger circuits (111–118) in the dynamic lighting module (11 or 14) with the matching identification code number. The least significant digit of the 8 bit binary number received by the EPROM-based 8 bit CMOS microcontroller (40) turns on or off the first lamp and trigger circuit (111). The next seven lamp and trigger circuits (112 through 118) are controlled in the same manner with the 8th lamp and trigger circuit (118) having its on-off state controlled by the most significant digit of the received 8 bit binary number. The third serially coded number is sent to the second eight lamp and trigger circuits (119–126) in the dynamic lighting module with the matching identification number. The least significant digit of the 8 bit binary number received turns on or off the 9th lamp and trigger circuit (119). The next seven lamp and trigger circuit (120 through 126) are controlled in the same manner with the 16th lamp and trigger circuit (126) controlled by the most significant digit of the received 8 bit binary number. All lamp and trigger circuits (111–126) remain in the same state until updated again because the 8 bit serial input latched parallel output integrated circuits (39 and 41) act to store the last data received until new data is received. After the third serially coded number is received, the microcontroller EPROM-based 8 bit CMOS microcontroller (40) in each dynamic lighting module (11 and 14) is ready for the next identification code number to be sent from the microprocessor controlled asynchronous serial data output (13).

This invention and its operation have been described in terms of a single preferred embodiment; however, numerous embodiments are possible without departing from the essential characteristics thereof. Accordingly, the description has been illustrative and not restrictive as the scope of the invention is defined by the appended claims, not by the description preceding them, and all changes and modifications that fall within the stated claims or form their functional equivalents are intended to be embraced by the claims.

I claim:

1. A lighting control module having as its input asynchronous serial data and having as an output an asynchronous serial data output suitable to serve as the input to a like lighting control module and a plurality of outputs, each of said plurality of outputs being suitable to control the on or off condition of individual lamps, comprising a serial to parallel lamp driver controller board, and a lamp driver board;

wherein the output of said serial to parallel lamp driver controller board is connected to the input of said lamp driver board, and the output of said lamp driver board is suitable for connection to the input of individual lamps; and wherein said serial to parallel lamp driver controller board comprises an input signal processor, a microcontroller, a serial input latched parallel output integrated circuit, and a crystal oscillator;

wherein the output of said input signal processor is connected to the input of said microcontroller and to the input of said serial input latched parallel output integrated circuit, the output of said microcontroller is connected as an input to the input signal processor, the output of said serial input latched parallel output integrated circuit is connected to the input of said lamp driver board, and the output of said crystal oscillator is connected as an input to said microcontroller; and wherein said lamp driver board provides electrical isolation between said lighting control module and each of said individual lamps.

2. A lighting control module having as its input an asynchronous serial data signal and having as its outputs an asynchronous serial data signal output suitable to serve as the input to a like lighting control module and a plurality of outputs, each of said plurality of outputs being suitable to control the on or off condition of an individual lamp, wherein said lighting control module operates in one of two modes, an initialization mode or a display mode;

wherein said initialization mode is commenced by said lighting control module receiving a reset code from said input asynchronous serial data signal, and said initialization mode is terminated by said lighting control module receiving an initialization termination code from said input asynchronous serial data signal;

wherein said display mode is commenced by said lighting control module receiving an initialization termination code from said input asynchronous serial data signal, and said display mode is terminated by said lighting control module receiving a reset code from said input asynchronous serial data signal;

wherein, during said initialization mode, said input asynchronous serial data signal assigns a unique address to said lighting control module, and after said lighting control module is assigned said unique address, receipt of an input asynchronous serial data signal causes said lighting control module to generate an asynchronous serial data signal output suitable to serve as the input to a like lighting control module;

wherein, during display mode, after receipt from said asynchronous serial data signal of a code word corresponding to said unique address, said lighting control module accepts the next code word from said input asynchronous serial data signal and generates said plurality of outputs, each of said plurality of outputs being suitable to control the on or off condition of an individual lamp; and wherein, during display mode, until receipt from said asynchronous serial data signal of a code word corresponding to said unique address, receipt of an input asynchronous serial data signal causes said lighting control module to generate an asynchronous serial data signal output suitable to serve as the input to a like lighting control module.

3. A lighting control system comprising a microprocessor controlled user interface, and a plurality of serially connected lighting control modules;

wherein the output of said user interface is an asynchronous serial data signal;

wherein the output of each said plurality of serially connected lighting control modules is an asynchronous serial data signal;

wherein said output of said user interface is connected to the input of the first of said plurality of serially connected lighting control modules;

wherein the input to the second and all subsequent of said serially connected lighting control modules is the output of a preceding serially connected lighting control module;

wherein each of said serially connected lighting control modules provides a microcontroller, and each of said serially connected lighting control modules provides one or more light sources;

wherein said asynchronous serial data signal is communicated to said microcontrollers, and wherein the on-off state of each of said light sources is determined by said microcontrollers acting upon said asynchronous serial data signal.

* * * * *